US006691382B1

(12) United States Patent
Su

(10) Patent No.: US 6,691,382 B1
(45) Date of Patent: Feb. 17, 2004

(54) RETAINER ADAPTED TO DETACHABLY SECURE TWO WIRED/GRILLED MEMBERS TOGETHER

(76) Inventor: Lien-Cheng Su, No. 13, Chingyang Rd., Liupao Tsun, Taya Hsiang, Taichung County (TW)

( * ) Notice: Subject to any disclaimer, the term of this patent is extended or adjusted under 35 U.S.C. 154(b) by 0 days.

(21) Appl. No.: 10/265,603

(22) Filed: Oct. 8, 2002

(51) Int. Cl.[7] ..... A44B 21/00; B65D 21/02

(52) U.S. Cl. ..... 24/545; 24/335; 24/336; 24/339; 24/543; 24/563

(58) Field of Search ..... 24/545, 563, 335, 24/336, 337, 339, 329

(56) References Cited

U.S. PATENT DOCUMENTS 3,228,640 A * 1/1966 Wolsh ..... 24/545
3,778,537 A * 12/1973 Miller ..... 24/335
4,707,892 A * 11/1987 Nelson ..... 24/336
5,054,636 A * 10/1991 Netzer ..... 24/545
5,181,297 A * 1/1993 Andrews, Jr. et al. ..... 24/563
5,309,604 A * 5/1994 Poulsen ..... 24/543
5,331,725 A * 7/1994 Chou ..... 24/545
5,409,198 A * 4/1995 Roick ..... 24/563
6,405,414 B1 * 6/2002 Byrnes et al. ..... 24/339
6,430,782 B1 * 8/2002 Torres et al. ..... 24/339

* cited by examiner

*Primary Examiner*—Victor Sakran
(74) *Attorney, Agent, or Firm*—Rosenberg, Klein & Lee

(57) ABSTRACT

A retainer injection-molded from tough plastics for securing two wire meshed/grilled members together, for enabling the two secured members to be turned relative to each other between the operative position and the collapsed position. The retainer has two transverse through holes arranged in parallel, and two peripheral gaps through which the respective wire rods of the first and second wire meshed/grilled members are respectively set into the transverse through holes.

4 Claims, 8 Drawing Sheets

RETAINER ADAPTED TO DETACHABLY SECURE TWO WIRED/GRILLED MEMBERS TOGETHER

BACKGROUND OF THE INVENTION

1. Field of the Invention

The present invention relates to retainers and, more particularly, to a retainer adapted to detachably secure two wired/grilled members together.

2. Description of the Related Art

FIG. 1 is a schematic drawing showing the shape forming of a C-shaped retainer 1 according to the prior art. This structure of C-shaped retainer 1 is commonly used to secure one wire meshed bottom panel 3 and one grilled side panel 4 of a basket 2, or two grilled side panels 4 of the basket 2 together. When installed, the C-shaped retainer 1 is scrimped to fixedly secure the two connected members together. This structure of C-shaped retainer 1 is not satisfactory in function because of the following drawbacks.

1. When installed, the C-shaped retainer 1 cannot easily be removed from the basket 2. i.e., the basket 2 is not detachable.
2. When using a tool to remove the C-shaped retainer 1 from the basket 2 in order to detach the basket 2, the C-shaped retainer 1 tends to be damaged.
3. When installed in the basket 2, the C-shaped retainer 1 tends to be forced out of place unless it is soldered to the basket 2.

SUMMARY OF THE INVENTION

The present invention has been accomplished under the circumstances in view. It is one object of the present invention to provide a retainer, which can conveniently detachably be fastened to two members to be secured together. It is another object of the present invention to provide a retainer, which is practical for use to secure parts of a basket, making the basket detachable when not in use. According to the present invention, the retainer is an oblong block injection-molded from tough plastics, having a first transverse through hole and a second transverse through hole arranged in parallel, a first gap in communication between the first transverse through hole and the space outside the retainer, a first springy arm disposed around the first transverse through hole and suspending above the first gap, a first stop block disposed at one side of the first through hole opposite to the first springy arm, a second gap in communication between the second transverse through hole and the space outside the retainer, a second springy arm disposed around the second transverse through hole at one side of the second gap, and a second stop block disposed at one side of the second gap opposite to the second stop block. According to one embodiment of the present invention, the first gap and the second gap are transversely disposed in parallel in one side of the retainer at different elevations. According to another embodiment of the present invention the first gap and the second gap are disposed in two sides of the retainer and arranged at right angles.

DETAILED DESCRIPTION OF THE PREFERRED EMBODIMENT

Figure 1:
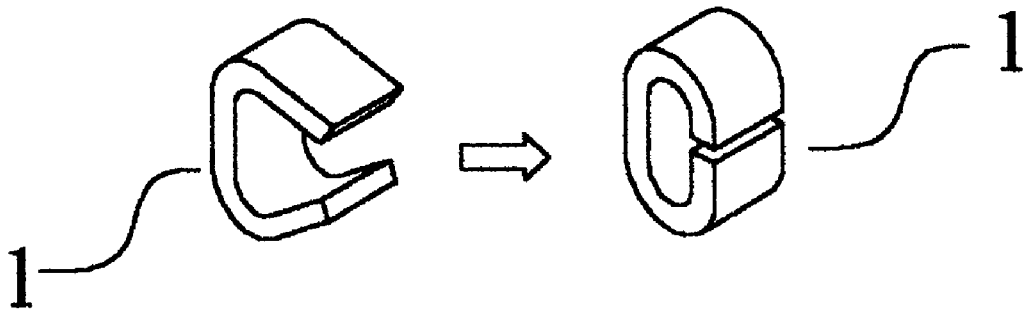
FIG. 1 is a schematic drawing showing the shape forming of a C-shaped retainer according to the prior art.
Figure 2:
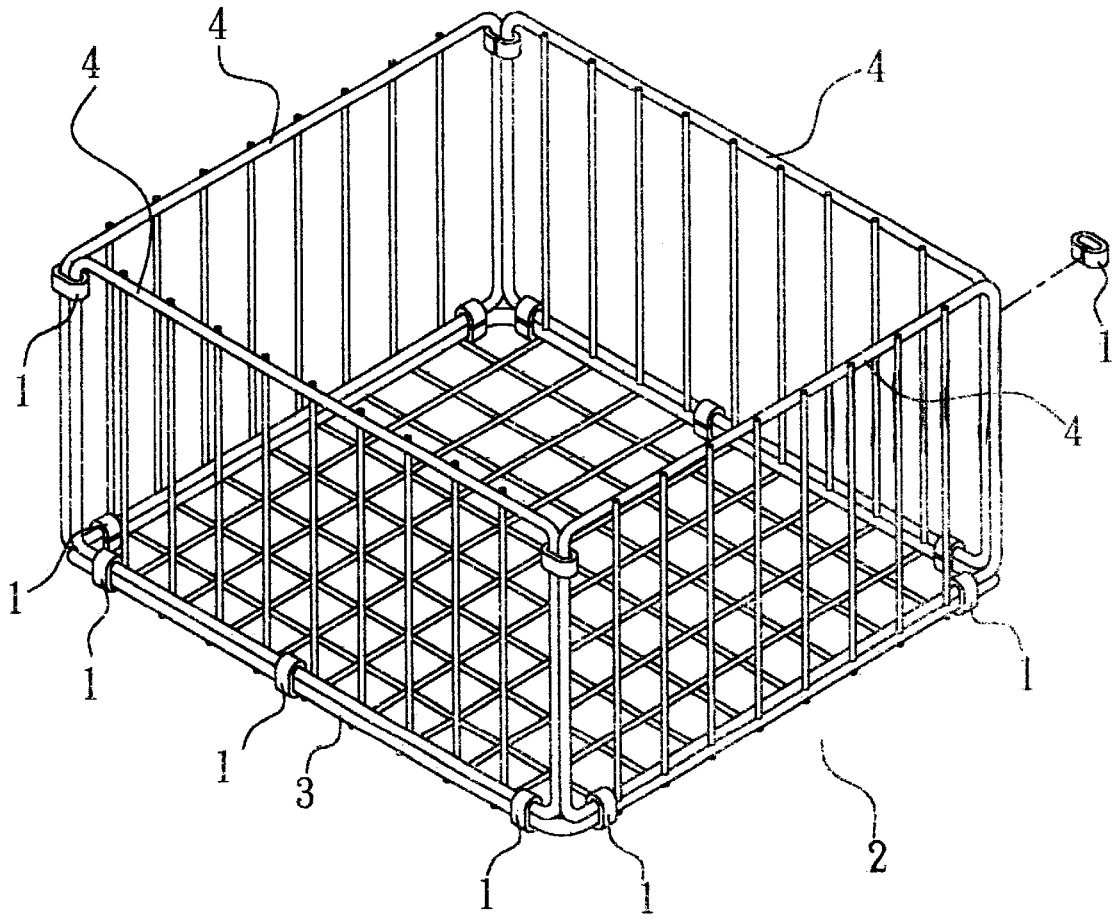
FIG. 2 is an applied view showing the prior art C-shaped retainer used in a basket.
Figure 3:
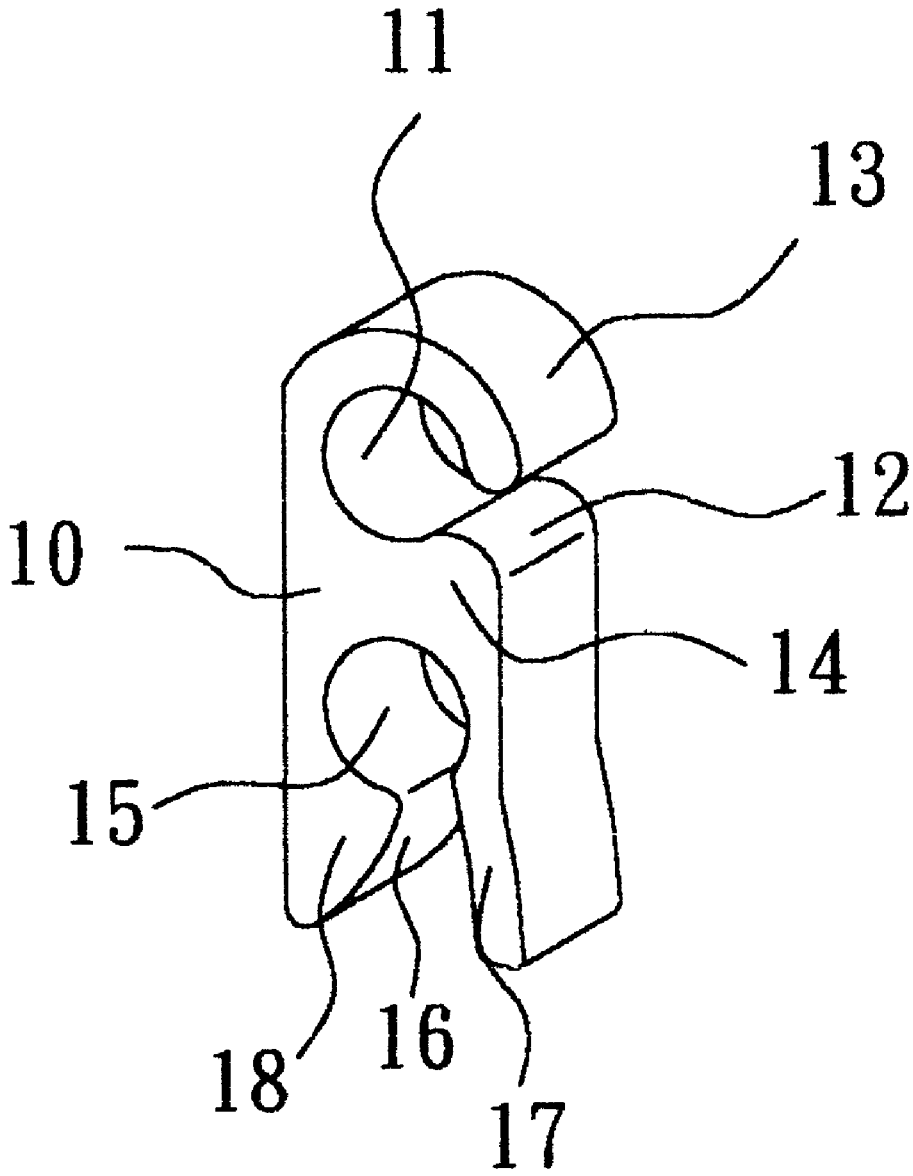
FIG. 3 is an elevational view of a retainer made according to the first embodiment of the present invention.
Figure 4:
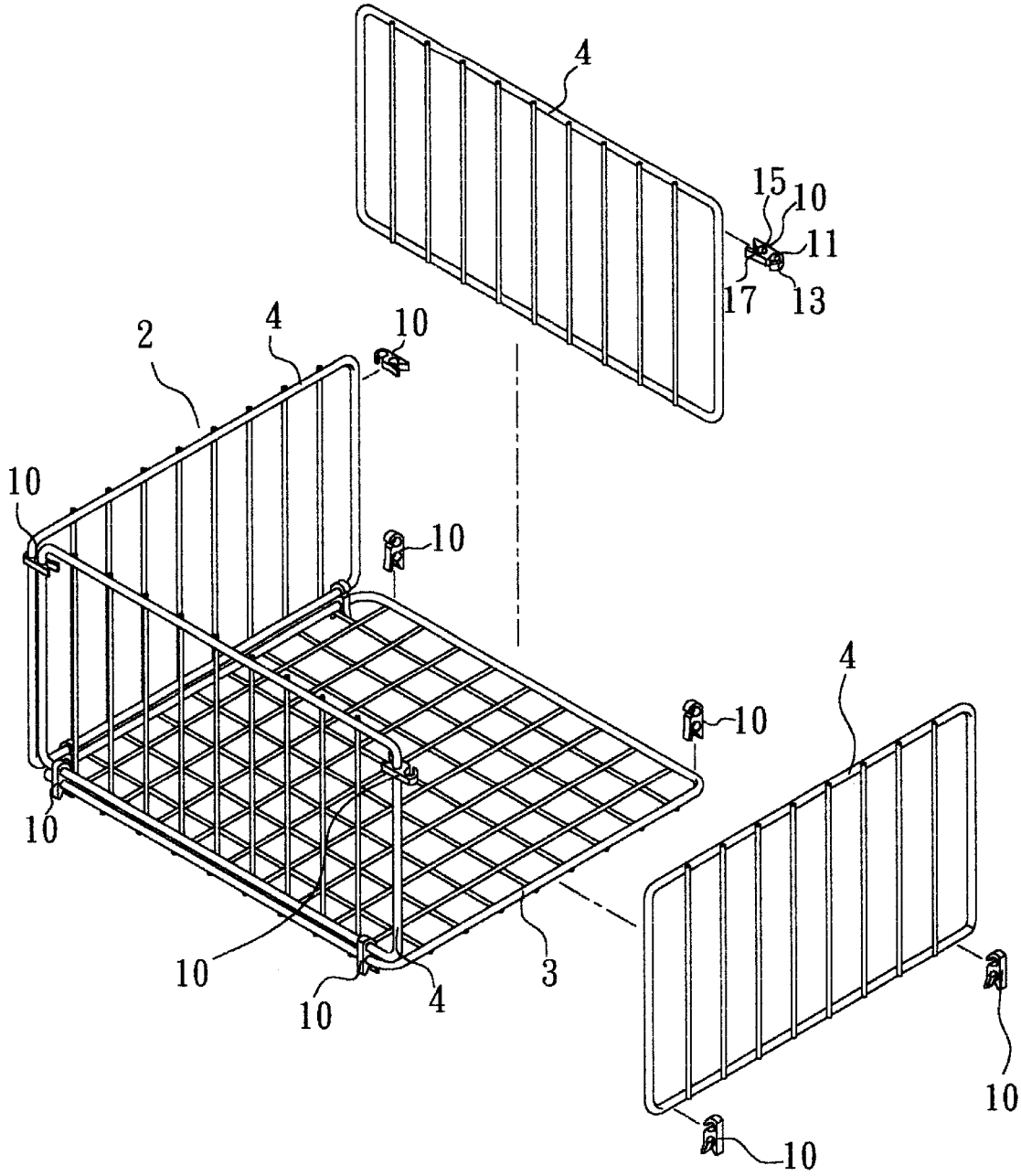
FIG. 4 is an exploded view of a basket showing the application of the present invention.
Figure 5:
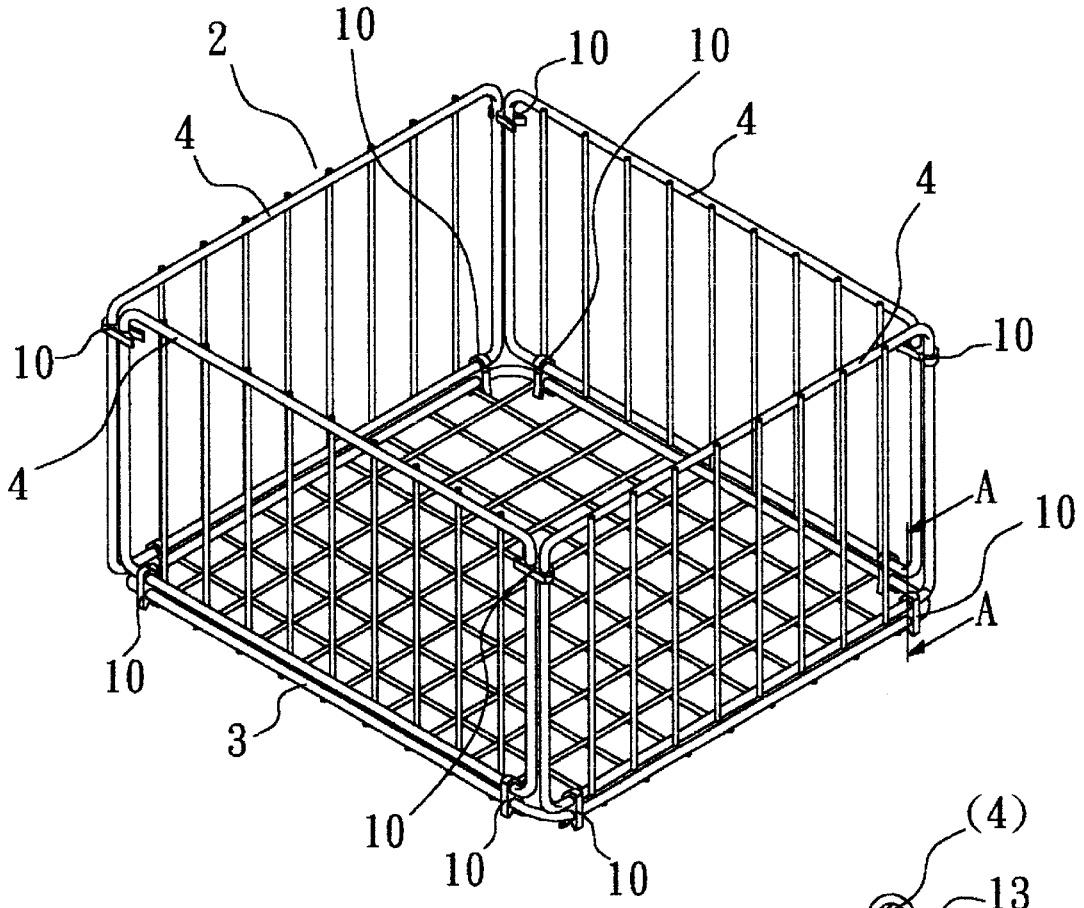
FIG. 5 is an assembly view of the basket shown in FIG. 4.
Figure 5A:
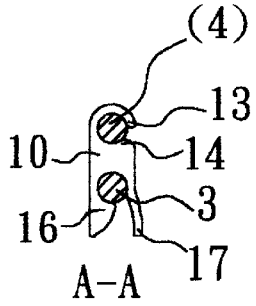
FIG. 5A is a sectional view in an enlarged scale taken along line A—A of FIG. 5.
Figure 6:
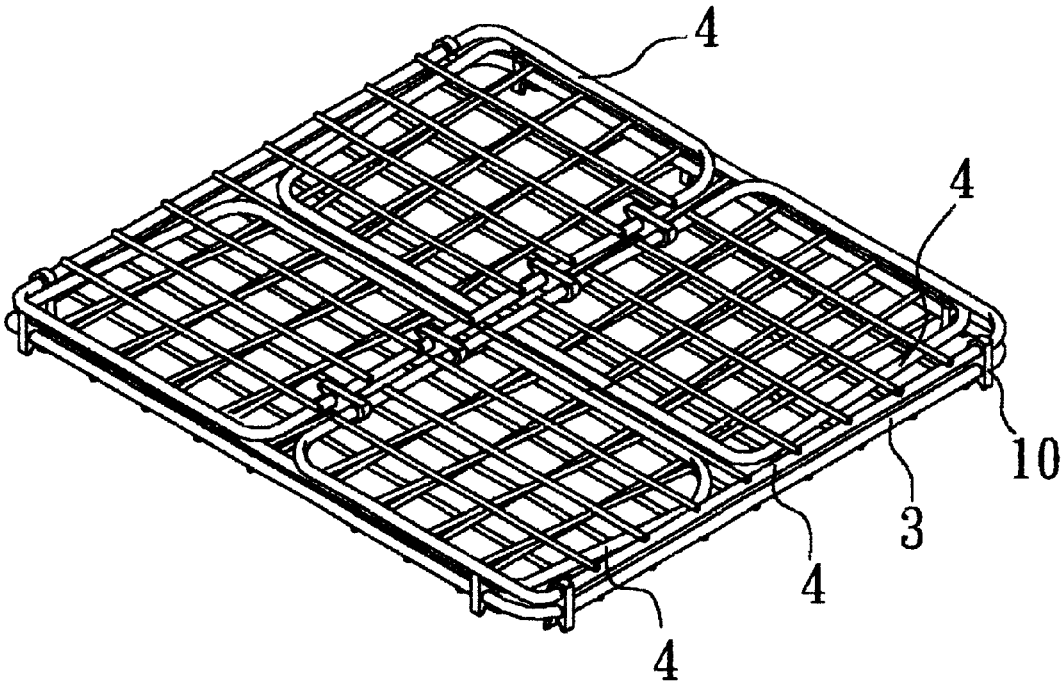
FIG. 6 shows the basket of FIG. 5 collapsed.

Referring to FIG. 3, a retainer 10 is a substantially oblong member injection-molded from tough plastics, having a first transverse through hole 11 and a second transverse through hole 15 arranged in parallel, a transverse side gap 12 in communication between the first transverse through hole 11 and the outside space, a smoothly arched springy arm 13 extended in transverse direction in one end thereof around the first transverse through hole 11 and suspending above the transverse side gap 12, a transverse stop block 14 provided between the first transverse through hole 11 and the second transverse through hole 15, a longitudinal bottom gap 16 perpendicularly extended from the second transverse through hole 15 to the other end thereof, a longitudinal springy arm 17 extended from one end of the transverse stop block 14 and suspended at one side of the second transverse through hole 15 and the longitudinal bottom gap 16, and a longitudinal stop block 18 extended from the other end of the transverse stop block 14 and suspended at the other side of the second transverse through hole 15 and the longitudinal bottom gap 16 opposite to the longitudinal springy arm 17.

FIGS. 4~7 show an application example of the present invention used to fasten a wire meshed bottom panel 3 and four grilled side panels 4 into a basket 2. By means of forcing the first transverse through hole 11 and the second transverse through hole 15 into engagement with a wire rod of the wire meshed bottom panel 3 and a wire rod of the grilled side panels 4, the retainer 10 is fastened to the wire meshed bottom panel 3 and the grilled side panels 4 to hold the wire meshed bottom panel 3 and the grilled side panels 4 at right angles. In the same way, the retainer 10 can be fastened to two grilled side panels 4 to hold the two grilled side panels 4 at right angles. Through the transverse side gap 12 or the bottom gap 16, a wire rod can be forced into the transverse through hole 11 or 15. Because the smoothly arched springy arm 13 and the transverse stop block 14 are disposed at two sides of the first transverse through hole 11 and the transverse side gap 12, the smoothly arched springy arm 13 can be bent slightly outwardly apart from the transverse stop block 14 to widen the transverse side gap 12 for enabling the wire rod to be forced into the first transverse through hole 11. When the wire rod set into the first transverse through hole 11, the smoothly arched springy arm 13 immediately returns to its former shape (due to the effect of its spring power) to narrow the transverse side gap 12 and to keep the loaded wire rod firmly in the first transverse through hole 11. The longitudinal springy arm 17 and the longitudinal stop block 18 are functioning in the same manner as the smoothly arched springy arm 13 and transverse stop block 14. Further, when the retainer 10 secures two grilled side panels 4, or one grilled side panel 4 and the wire meshed bottom panel 3 together, the two grilled side panels 4 or the grilled side panel 4 with the wire meshed bottom panel 3 can be turned relative to each other between the operative position (see FIG. 5) and the collapsed position (see FIG. 6).

Figure 7:
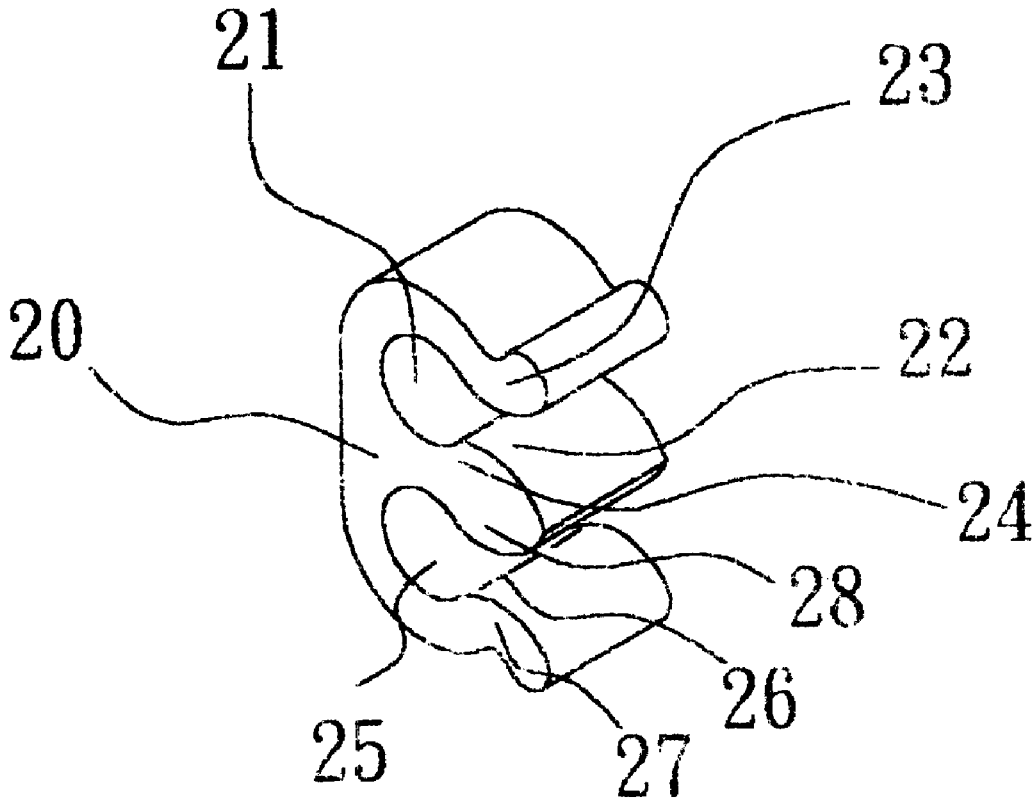
FIG. 7 is an elevational view of a retainer made according to the second embodiment of the present invention.
Figure 8:
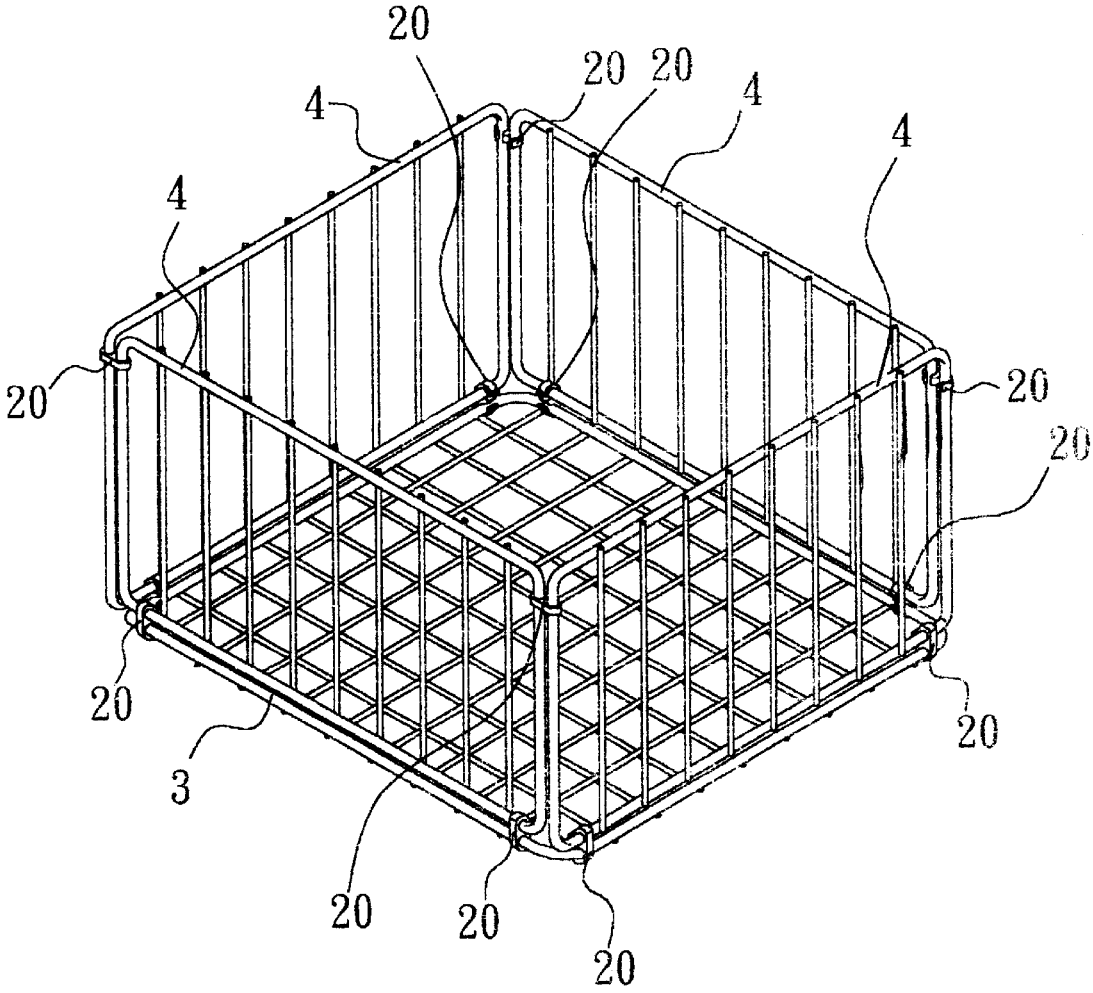
FIG. 8 is an elevational view showing the retainer of the second embodiment of the present invention used in a basket

FIGS. 7 and 8 show an alternate form of the present invention. According to this embodiment, the retainer 20 has a first transverse through hole 21 and a second transverse through hole 25 arranged in parallel, a first transverse side gap 22 in communication between the first transverse through hole 21 and the outside space, a second transverse side gap 26 in communication between the second transverse through hole 25 and the outside space, a first smoothly arched springy arm 23 extended in transverse direction in one end thereof around the first transverse through hole 21 and suspending above the first transverse side gap 12, a second smoothly arched springy arm 27 extended in transverse direction in the other end thereof around the second transverse through hole 25 below the second transverse side gap 26, a first stop block 24 provided between the first transverse through hole 21 and the second transverse through hole 25, and a second stop block 28 provided between the first transverse through hole 21 and the second transverse through hole 25 and formed integral with the first stop block 24. Actually, this embodiment is similar to the embodiment shown in FIG. 3 with the exception of the extending direction of the transverse side gap 26, the second smoothly arched springy arm 27, and the second stop block 28.

A prototype of retainer has been constructed with the features of FIGS. 3 and 8. The retainer functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A retainer injection-molded from tough plastics, comprising:

a body having formed therein a first transverse through hole and a second transverse through hole arranged in parallel, said body having formed therein a first gap in communication with said first transverse through hole and extending radially outward therefrom to the space outside the retainer, said body defining a first springy arm disposed around said first transverse through hole and suspending above said first gap, and a first stop block disposed at one side of said first through hole opposite said first springy arm, said body having formed therein a second gap in communication with said second transverse through hole and extending radially outward therefrom to the space outside the retainer, said second gap being angularly offset in orientation relative to said first gap, said body defining a second springy arm disposed around said second transverse through hole at one side of said second gap, and a second stop block disposed at one side of said second gap opposite said second stop block.

2. The retainer as claimed in claim 1, wherein said first gap and said second gap are disposed in two adjacent sides of the retainer and arranged at right angles.

3. The retainer as claimed in claim 1, wherein said first and second transverse through holes are formed in respective first and second portions of said body, said first and second portions being asymmetrically configured one relative to the other.

4. The retainer as claimed in claim 1, wherein said first and second transverse through holes respectively define open side and bottom gaps.

* * * * *